US005743342A

United States Patent [19]

Gibbs

[11] Patent Number: 5,743,342

[45] Date of Patent: Apr. 28, 1998

[54] GRADER CIRCLE ASSEMBLY

[75] Inventor: James Dennis Gibbs, Harrogate, Tenn.

[73] Assignee: CBJ Plating and Machine of Tennessee, Knoxville, Tenn.

[21] Appl. No.: 651,393

[22] Filed: May 22, 1996

[51] Int. Cl.[6] ..... E02F 3/76

[52] U.S. Cl. ..... 172/781; 172/734

[58] Field of Search ..... 172/781, 792, 172/793, 796, 799, 742, 272, 741, 734

[56] References Cited

U.S. PATENT DOCUMENTS

| | | | |
|---|---|---|---|
| 3,425,497 | 2/1969 | Strabala et al. | 172/792 |
| 3,463,243 | 8/1969 | Fisher | 172/781 |
| 3,470,967 | 10/1969 | Page et al. | 172/793 |
| 3,512,589 | 5/1970 | Ulrich . | |
| 3,786,871 | 1/1974 | Long et al. | 172/793 X |
| 3,999,615 | 12/1976 | Hart et al. | 172/796 |
| 4,016,936 | 4/1977 | Easterling et al. | 172/796 |
| 4,084,644 | 4/1978 | Cole et al. | 172/796 |
| 4,113,032 | 9/1978 | Cole | 172/781 |
| 4,122,903 | 10/1978 | Cole | 172/781 |

OTHER PUBLICATIONS

"Chassis Diagram: 16G Motor Grader", Caterpillar Tractor Company, Peoria, IL.

"Chassis Diagram: 14G Motor Grader", Caterpillar Tractor Company, Peoria, IL.

*Primary Examiner*—Terry Lee Melius
*Assistant Examiner*—Christopher J. Novosad
*Attorney, Agent, or Firm*—Pitts & Brittian, P.C.

[57] ABSTRACT

An improved grader circle for reinforcing the outer surface of a circle. The improved grader circle assembly of the present invention includes a circle defining an outer surface from which two vertical beams extend in an opposing manner. A front reinforcement plate is welded to the outer surface of the circle at a front portion thereof and the front reinforcement plate extends between the first ends of each of the vertical beams. Two rear reinforcement plates are welded to the outer surface of the circle at a rear thereof, one each between the second ends of the vertical beams and the tip cylinder bracket.

5 Claims, 2 Drawing Sheets

GRADER CIRCLE ASSEMBLY

TECHNICAL FIELD

This invention relates to the field of grader circles for motor graders.

BACKGROUND ART

A motor grader is generally comprised of a main frame with a dirigible wheel assembly at a front end, an operator's cab at a rear end thereof, and a traction chassis for the motor and power train behind the cab. A motor grader blade is suspended from the main frame by means of a circle and beam assembly. The circle rotates about a vertical axis and the motor controls the rotary motion of the circle. The grader blade is mounted to the circle via the beam assembly which is secured to the circle. The rotation of the circle changes the angle of the blade. Further, the blade is mounted on a horizontal axis so that it may be tipped with respect to the circle.

Several conventional circles in use today define a configuration which leaves the circle subject to failure when heavy loads are processed by the motor grader.

Therefore, it is an object of the present invention to provide an improved grader circle which is resistant to premature failure.

It is another object of the present invention to provide an improved grader circle which includes reinforcements at stress points.

SUMMARY

Other objects and advantages will be accomplished by the present invention which provides an improved grader circle with reinforced stress point. The improved grader circle assembly of the present invention includes a circle defining an outer surface from which two vertical beams extend in an opposing manner. Each of the vertical beams defines an upper portion which includes a first end and a second end, the upper portion being secured to the outer surface of the circle. The circle carries a tip cylinder bracket at a rear of the circle between the vertical beams. A front reinforcement plate is welded to the outer surface of the circle at a front portion thereof and the front reinforcement plate extends between the first ends of each of the vertical beams. Two rear reinforcement plates are welded to the outer surface of the circle at a rear thereof, one each between the second ends of the vertical beams and the tip cylinder bracket.

BRIEF DESCRIPTION OF THE DRAWINGS

The above mentioned features of the invention will become more clearly understood from the following detailed description of the invention read together with the drawings in which.

DESCRIPTION OF PREFERRED EMBODIMENTS

An improved grader circle incorporating various features of the present invention is illustrated generally at 10 in the figures. The improved grader circle 10 is designed to prevent premature failure of a conventional circle. Moreover, in the preferred embodiment the improved grade circle 10 is includes reinforcements at stress points.

Figure 1:
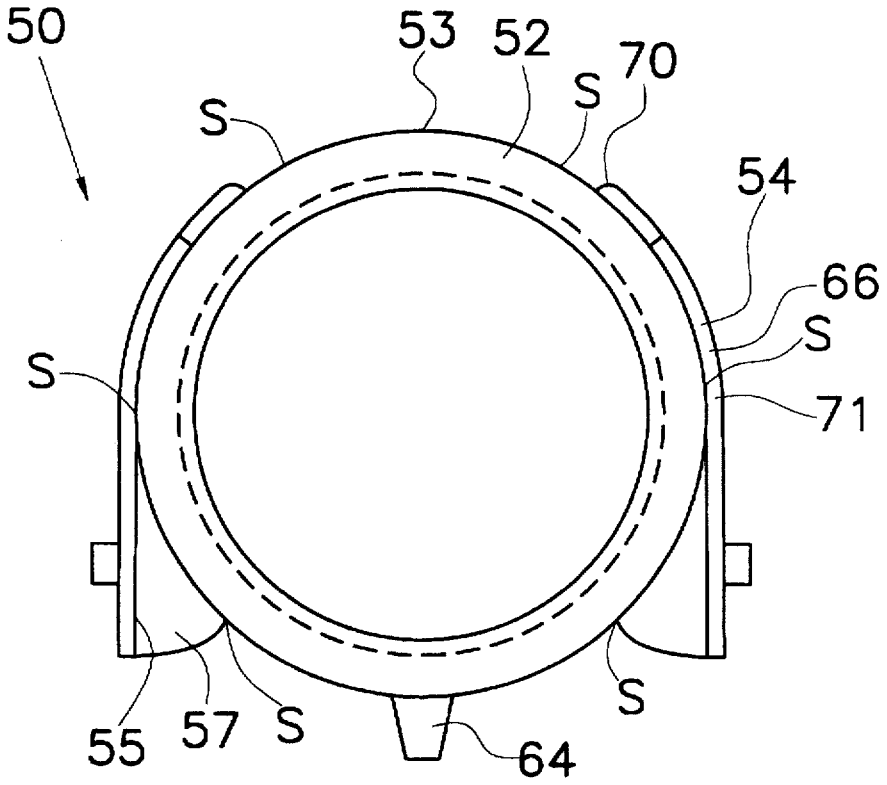
Fig. 1 (PRIOR ART)
FIG. 1 is a top view of a grader circle of the prior art
Figure 2:
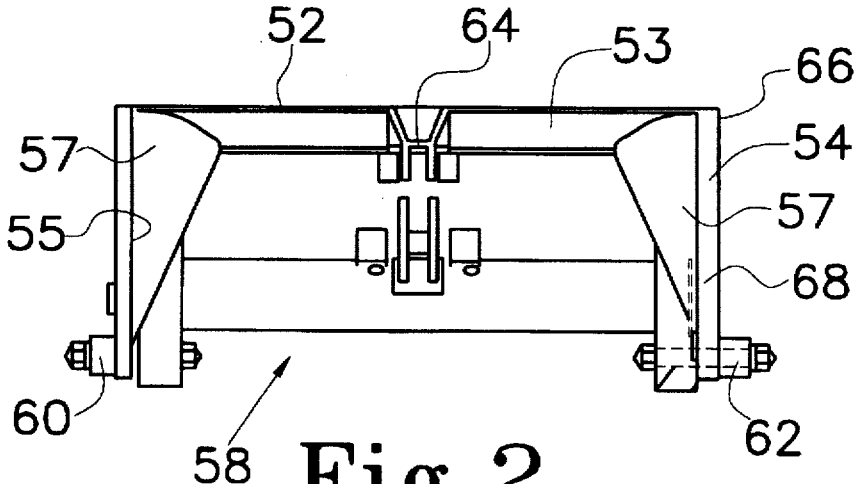
Fig. 2 (PRIOR ART)
FIG. 2 is a rear view of the grader circle of FIG. 1.

A conventional circle and beam assembly 50 manufactured by Caterpillar Tractor Company is illustrated in FIG. 1. Specifically, the circle configuration of model 14G Grader circles, manufactured for serial numbers 96U6343 and up, and model 16G Grader circles, manufactured for serial numbers 93U2340 and up, is illustrated in FIGS. 1 and 2. Both of these circles have the same typical design with small variances in dimensions. Although several circle assemblies have been developed over the years, Caterpillar motor graders equipped with models 14G and 16G circle and beam assemblies are among the most frequently used.

The circle and beam assembly 50 includes a circle 52 to which two vertical beams 54 are secured, as shown in FIG. 1. The vertical beams 54 extend from opposing sides of the circle 52. Specifically, each of the vertical beams 54 defines an upper portion 66 and a lower portion 68. The upper portion 66 includes a first end 70 and a second end 71, the segment of the vertical beam 54 between the first 70 and second end 71 is secured to the circle 52. A brace 57 is secured to an inner surface 55 of each beam 54 and the outer surface 53 of the circle 52. The circle and beam assembly depicted varies from earlier model 14G and 16G Grader circles. Specifically, instead of having one tip bracket mounted on the outside of each vertical beam 54 to hold a blade, all the cross bracing was removed and a single heavy duty tip bracket assembly 58 was mounted between the two vertical beams 54 on the inside, as shown in FIG. 2. Each vertical beam 54 defines a boss 60 carried 60 on the outer surface at the lower portion 68 thereof. Hinge pins 62 are received through each boss 60 and the bracket assembly 58. Further, a blade tip cylinder mount bracket 64 is secured to the outer surface 53 of the circle 52 at the rear thereof between the vertical beams 54. The configuration of the tip bracket assembly 58 takes much of the strength out of the circle 52 needed for heavy jobs. Because of the ability of the circle 52 to flex more at stress points, indicated with an "s" on FIG. 1, the circle 52 tends to crack or break at these locations.

Figure 3:
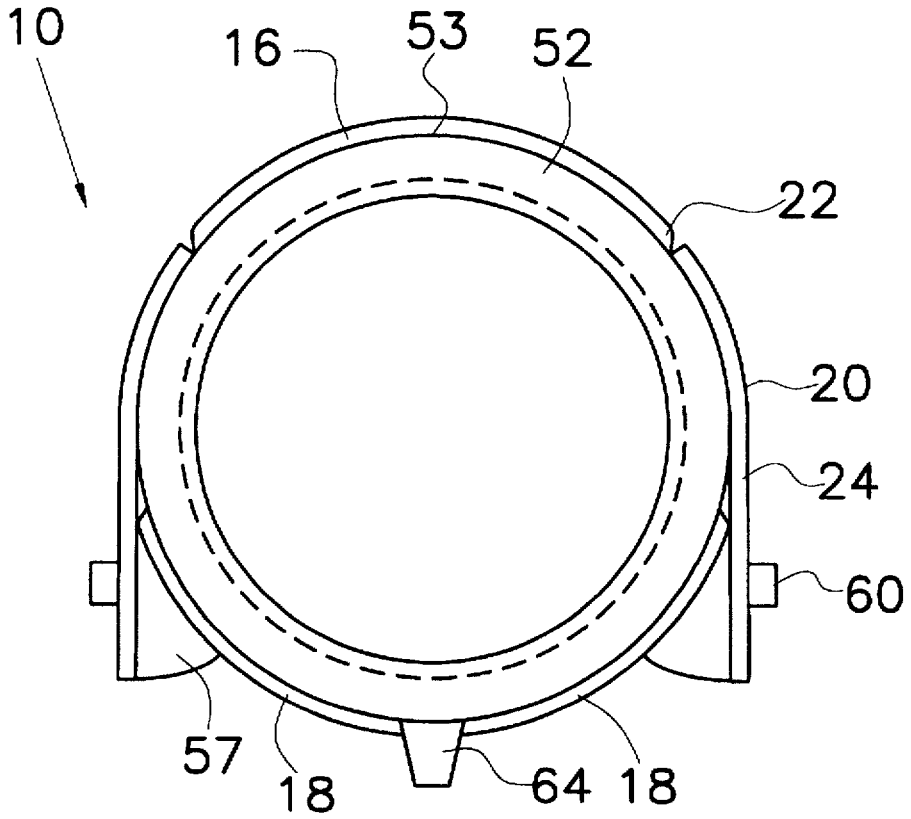
FIG. 3 is a top view of the improved grade circle constructed in accordance with several features of the present invention.

The improved grader circle 10 of the present invention includes reinforcement plates 16, 18 welded to the outer surface 14 of the circle 52 to strengthen the circle and eliminate the stress points. Specifically, the improved grader circle 10 includes at least a front reinforcement plate 16 welded to the front of the circle 52 which ties the first ends 22 of the two vertical beams 54 together, as shown in FIG. 3. In the preferred embodiment, the vertical beams 20 of the improved grader circle 10 are configured differently than those of the prior art. Specifically, the first end 22 of each beam 20 is shortened in length, compared to that of the prior art, and the front reinforcement plate 14 defines a length such that extends between the first end 22 of each beam 20, as shown in FIG. 3. Further, rear reinforcement plates 18 are welded to the rear of the circle 52, one between the blade tip cylinder mount bracket 64 and each of the second ends 24 of the vertical beams 20, as shown in FIG. 3. Preferably, the reinforcement plates 16, 18 are cross welded to the circle 52 such that the weld is not subject to early failure.

The reinforcement plates 16, 18 serve to strengthen the circle 52 and distribute stress to the entire circle 52. In the circle 52 of the prior art shown in FIG. 1, two stress points are located proximate the first end 70 of each vertical beam 54 at the front of the circle 52. The first end 22 of each of the vertical beams 20 of the improved grader circle 10 are shortened such that the front reinforcement plate 16 can sufficiently extend beyond the stress points.

In the preferred embodiment, the reinforcement plates 16, 18 are fabricated from steel. Preferably, the front reinforcement plate 16 is 1½ inches in depth and 6 inches wide. The rear reinforcement plates 18 are 1 inch in depth the 6 inches wide. The length of each plate will depend upon the model to which the plates are welded. Specifically, for model 16G circles, the front reinforcement plate 16 is 72 inches long and each of the rear reinforcement plates 18 is 48 inches long.

From the foregoing description, it will be recognized by those skilled in the art that an improved grader circle offering advantages over the prior art has been provided. Specifically, the improved grader circle is resistant to premature failure and includes reinforcement plates at stress points.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

I claim:

1. An improved grader circle comprising:

said improved grader circle comprising:

a circle defining an outer surface;

two vertical beams each defining an upper portion which includes a first end and a second end, said upper portion of each of the vertical beams being secured to said outer surface, said two vertical beams extending from said circle in an opposing manner;

a tip cylinder bracket being carried at a rear of said circle between the vertical beams; and, a front reinforcement plate welded to said outer surface at a front portion of said circle, said front reinforcement plate extending between said first ends of each of said vertical beams, said front reinforcement plate for distributing stress over said front of said circle.

2. The improved grader circle of claim 1 further including two rear reinforcement plates which cooperate with said front reinforcement plate to distribute stress over said circle, said rear reinforcement plates welded to a rear of said circle, one of said rear reinforcement plates extending between the tip cylinder bracket and each of said second ends of said upper portion of said vertical beams.

3. An improvement to a motor grader circle which includes a circle from which two vertical beams extend in an opposing manner, each of the vertical beams defining an upper portion with a first end and a second end, the upper portion being secured to an outer surface of the circle, the circle carrying a tip cylinder bracket on the outer surface at a rear thereof between the second ends of the upper portion of each vertical beam, stress points being defined around the circle, said improvement comprising:

a front reinforcement plate welded to the outer surface at a front portion of the circle, said front reinforcement plate extending between the first ends of the upper portion of each of the vertical beams, said front reinforcement plate for reinforcing at least one stress point and distributing stress over the front of said circle.

4. The improvement of claim 3 further including two rear reinforcement plates each of which reinforcing at least one stress point and cooperating with said front reinforcement plate to distribute stress over the circle, said rear reinforcement plates welded to a rear of the circle, one each of said rear reinforcement plates extending between the tip cylinder bracket and each of the second ends of the upper portion of the vertical beams.

5. The improvement of claim 3 wherein a first distance between the first and second ends of the upper portion of each vertical beam is such that a second distance between each first end and a respective stress point is increased, said front reinforcement plate extending between the first end of each vertical beam.

* * * * *